United States Patent [19]

Hamann

[11] Patent Number: 4,796,369

[45] Date of Patent: Jan. 10, 1989

[54] FLOOR SIGN EXTENSION ATTACHMENT

[75] Inventor: David L. Hamann, Cincinnati, Ohio

[73] Assignee: Rubbermaid Commercial Products Inc., Winchester, Va.

[21] Appl. No.: 511,259

[22] Filed: Jul. 6, 1983

[51] Int. Cl.[4] ..... G09F 15/00

[52] U.S. Cl. ..... 40/606; 40/610; 116/63 P

[58] Field of Search ..... 40/606, 610, 611, 607; 116/63 P; 16/171; 248/166; 256/64; 404/6

[56] References Cited

U.S. PATENT DOCUMENTS

| | | | |
|---|---|---|---|
| 2,520,236 | 8/1950 | Carver | 116/63 P |
| 2,525,728 | 10/1950 | Sauer | 116/63 P |
| 2,718,080 | 9/1955 | Eaton | 116/63 P |
| 2,844,897 | 7/1958 | Vance, Jr. | 40/611 |
| 2,863,238 | 12/1958 | Keech | 40/606 |
| 3,231,994 | 1/1966 | Cyrus | 116/63 P |
| 3,490,749 | 1/1970 | Anderson | 116/63 P |
| 4,005,537 | 2/1977 | Von Camber et al. | 40/610 |
| 4,253,260 | 3/1981 | Maza et al. | 40/610 |
| 4,279,105 | 7/1981 | Cameron | 40/610 |
| 4,298,186 | 11/1981 | Glass | 40/606 |

FOREIGN PATENT DOCUMENTS

| | | | |
|---|---|---|---|
| 2460017 | 2/1981 | France | 40/612 |
| 605390 | 5/1960 | Italy | 116/63 P |
| 851483 | 10/1960 | United Kingdom | 40/610 |

OTHER PUBLICATIONS

3 Catalog sheets—Protect Pedestrians—published 1980 by Walton-March Inc., Highland Park, Ill. 60035.

1 Catalog sheet—published 1980 by Baystate/Dover Corporation, 427 Plymouth Ave., Fall River, Mass. 02722.

1 Catalog sheet—published 1982 by Continental, 1101 Warson Rd., St. Louis, Mo. 63132.

*Primary Examiner*—Gene Mancene
*Assistant Examiner*—J. Hakomaki
*Attorney, Agent, or Firm*—Renner, Kenner, Greive, Bobak, Taylor & Weber

[57] ABSTRACT

A sign extension attachment for a self-standing floor sign having two panels (28) and (29) connected at their upper ends by hinge means (30) including a transverse handle (31), the attachment comprising a panel (10) having spreadable sleeve portions (18) and (22) for wrapping around the handle (31).

10 Claims, 4 Drawing Sheets

FIG. 1
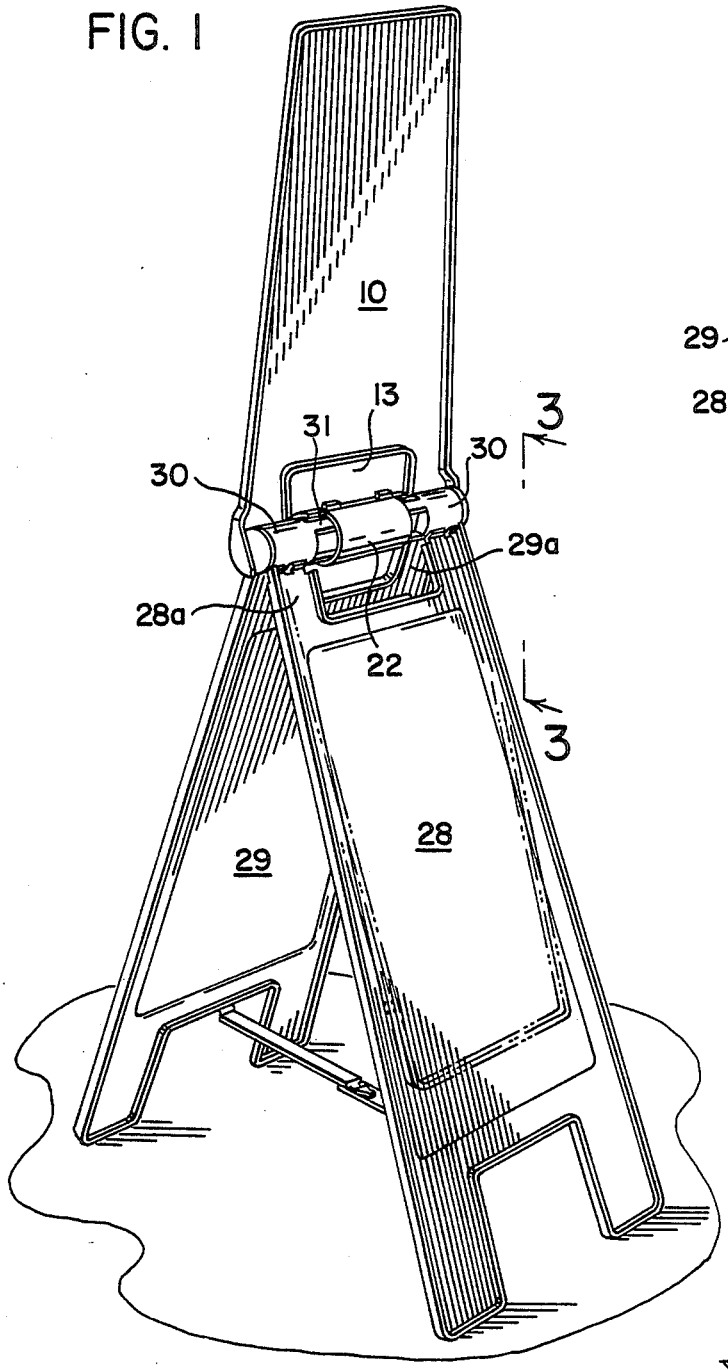
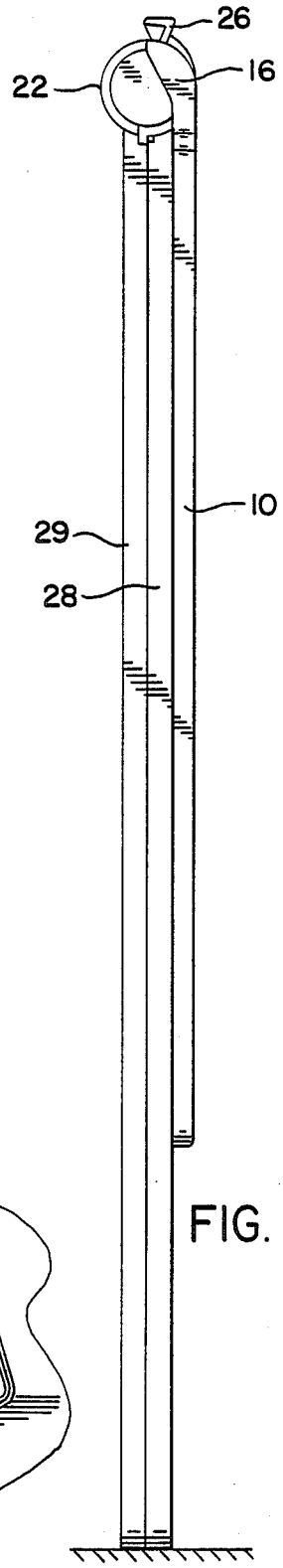
FIG. 2

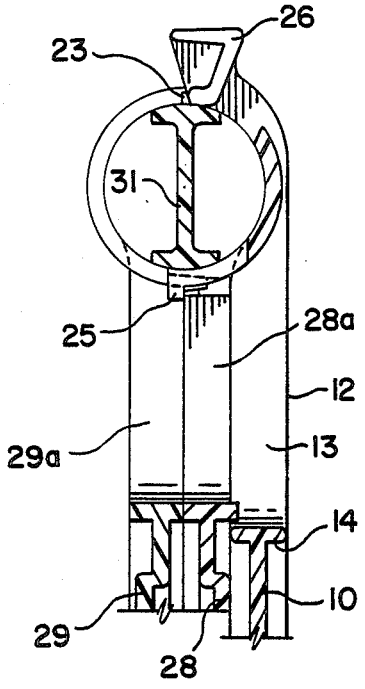
FIG. 8
FIG. 9
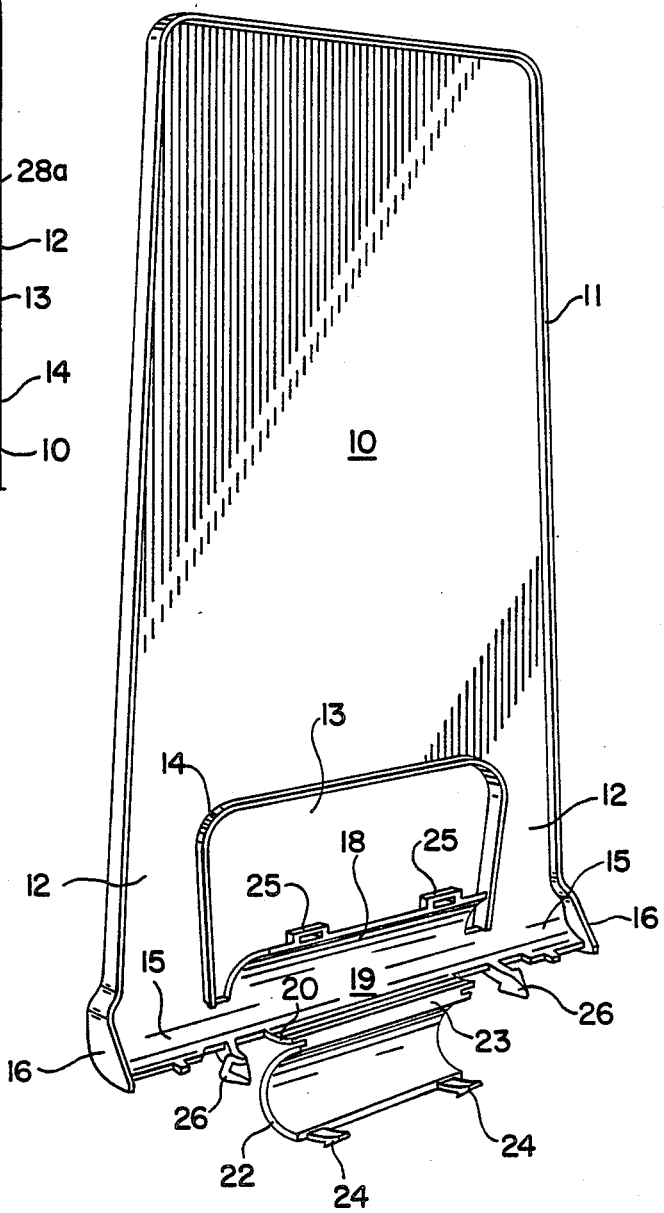

FLOOR SIGN EXTENSION ATTACHMENT

TECHNICAL FIELD

The invention relates to self-standing floor signs used on wet or newly waxed or painted floors to warn or caution pedestrians traversing the floors of the surface conditions.

BACKGROUND ART

Prior U.S. Pat. No. 4,253,260 shows a self-standing floor sign having two plastic panels hinged together at their upper ends for selective folding or spreading the panels apart at their lower ends to a triangular self-standing position. The upper ends of the panels are provided with laterally spaced legs forming a central slot therebetween and the legs have interconnected hinge portions with a cross bar handle extending between and connecting the hinge portions.

The warning or cautionary signs normally placed upon the panels are visible close up but not at some distance due to their insubstantial height above the floor, especially if some obstruction bars the view. Consequently, pedestrians may often tread upon the floor before seeing the warning sign.

DISCLOSURE OF THE INVENTION

The novel and improved attachment disclosed and described herein has a sign panel designed and adapted to be detachably mounted on the upper handle portion of a self-standing floor sign for extending upright therefrom or folding down against one of the lower panels of the sign.

It is an object of the present invention to provide an improved sign extension adapted to be quickly attached to and detached from a cross bar handle connecting laterally spaced hinged leg portions at the upper ends of hinged floor sign panels.

Another object is to provide an improved sign extension having novel releasable attaching means for encircling said cross bar handle.

A further object is to provide an improved sign extension having novel attaching means pivotally encircling the cross bar handle of a floor sign to allow folding the extension flat against one of the lower sign panels.

A still further object is to provide an improved sign extension having improved means for yieldably abutting the laterally spaced leg portions of one of the lower sign panels to maintain the sign extension in upright position.

Still another object is to provide an improved sign extension accomplishing all of the foregoing objects and constructed entirely of plastic material.

These and other objects are accomplished by the improvements comprising the present invention, a preferred embodiment of which is illustrated and described herein as exemplifying the best known mode of carrying out the invention. Various modifications and changes in details of construction are comprehended within the scope of the appended claims.

BRIEF DESCRIPTION OF THE DRAWINGS

FIG. 1 is a front perspective view of a floor sign with the improved attachment mounted thereon in extended position.

FIG. 2 is a side elevation showing the sign folded and the attachment folded down against the front sign panel.

FIG. 8 is a cross section on line 8—8 of FIG. 3.

FIG. 9 is a detached perspective view of the attachment with the mounting portion open.

PREFERRED EMBODIMENT OF THE INVENTION

Figure 3:
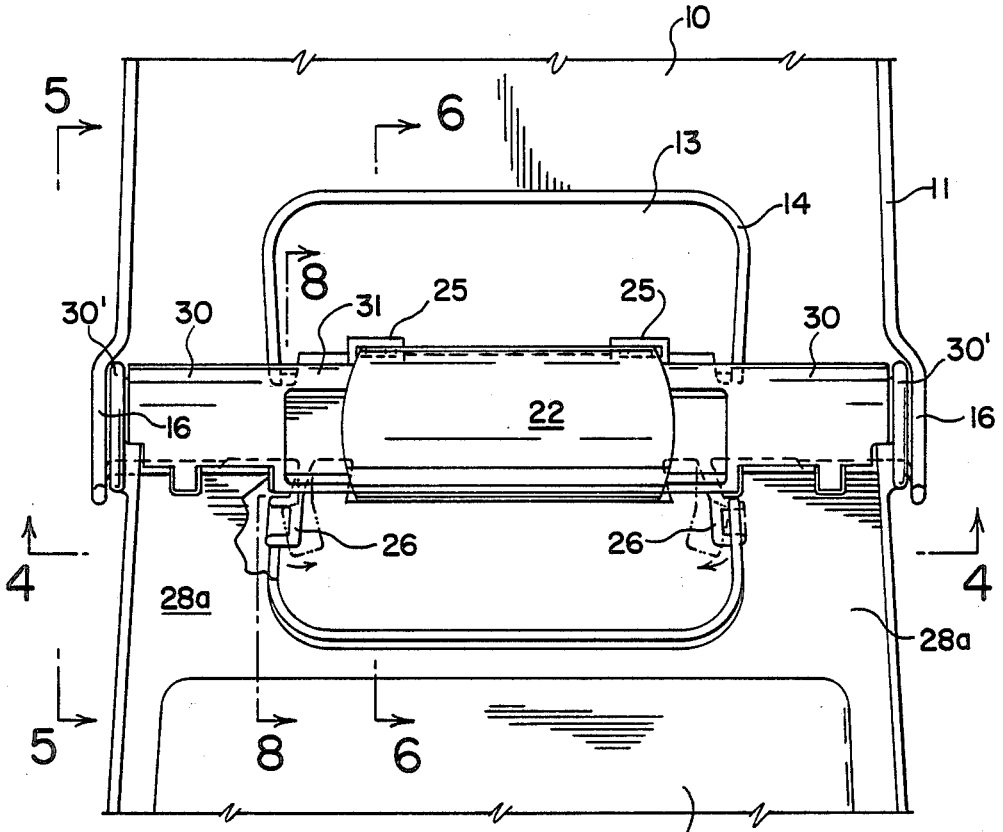
FIG. 3 is an enlarged partial front elevation showing the connection between the attachment in extended position and the floor sign.
Figure 4:
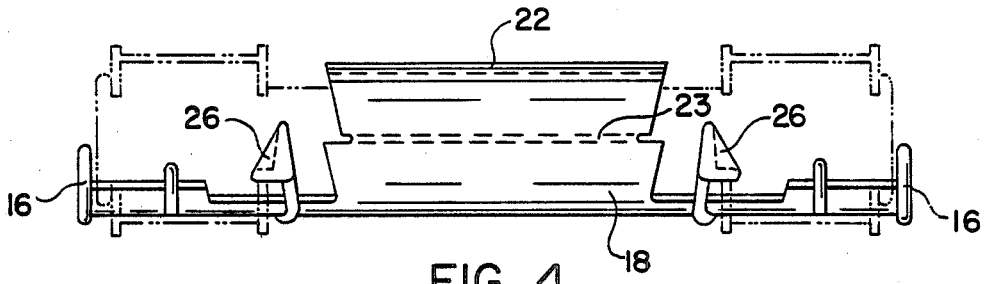
FIG. 4 is an elevation on line 4—4 of FIG. 3, showing the handle portion of the sign in phantom.
Figure 5:
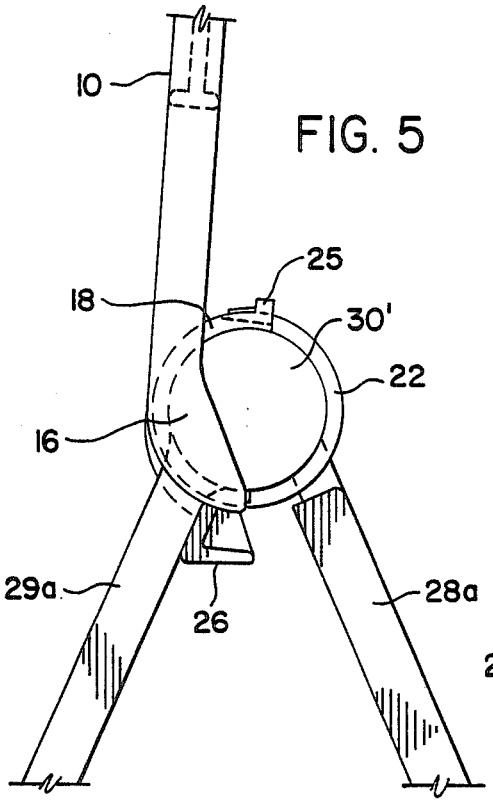
FIG. 5 is a side elevation on line 5—5 of FIG. 3.
Figure 6:
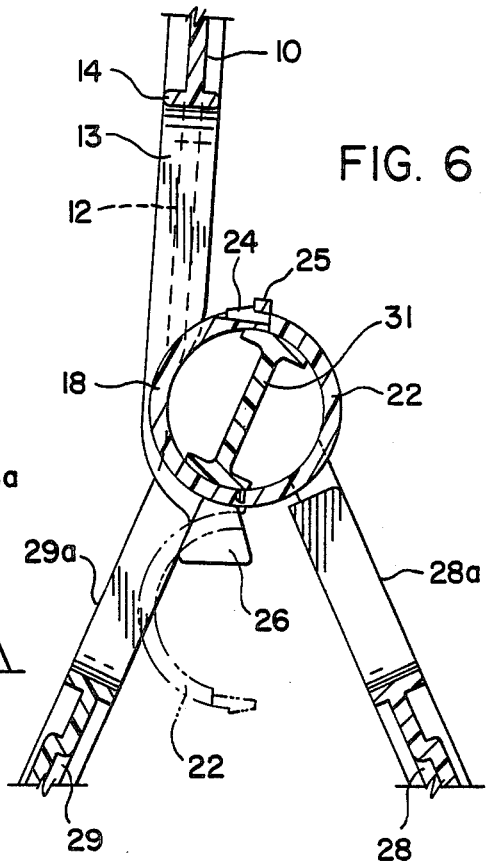
FIG. 6 is a cross section on line 6—6 of FIG. 3.
Figure 7:
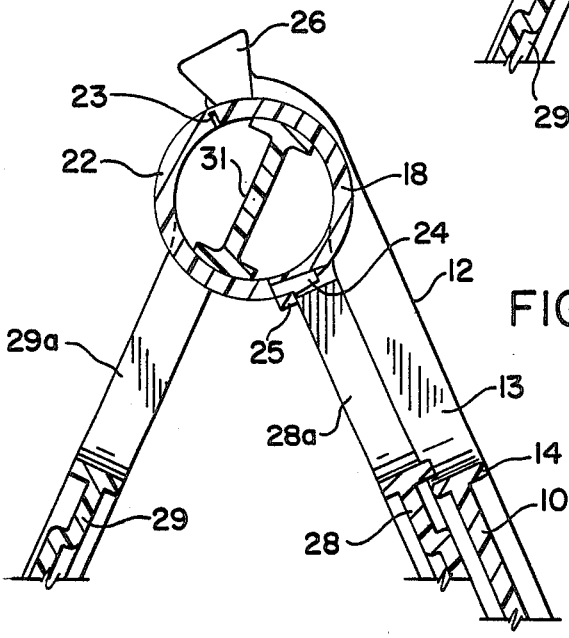
FIG. 7 is a similar view showing the attachment folded down against the front panel of the floor sign.

Referring first to FIG. 9, the improved attachment comprises a substantially rectangular panel portion 10 with a peripheral flange 11 extending around two sides and one end. At the other end, panel 10 has laterally spaced leg portions 12 forming a substantially rectangular opening 13 preferably having a peripheral flange 14 around its upper and side edges. The leg portions 12 terminate in curved surfaces 15 and the side portions of peripheral flange 11 terminate in enlarged flange portions 16 defining the ends of the curved leg surfaces.

At the lower edge of opening 13 an upwardly curved attaching wing 18 is formed, and its inner curved surface merges into the curved surface 19 which connects the curved surfaces 15 of the legs 12. At the lower edge of the curved surface 19, a curved flange 20 is projected and forms with the wing 18 and surface 19 a semi-cylindric mounting sleeve.

A lower semi-cylindric mounting sleeve or wing 22 is hinged to the outer edge of flange 20 by means of a thin web 23. The material of which the improved attachment is formed is preferably polypropylene which has the well-known property of providing in thin section a flexible so-called "living hinge" which lasts for an indefinite period of time. The lower edge of sleeve 22 is provided with barbed tabs 24 which are adapted to be inserted and locked into slotted ears 25 on the upper edge of wing 18. Laterally spaced from the flange 20 are laterally yieldable barbed tongues 26, the purpose of which will be described.

Referring to FIGS. 1 and 3, the floor sign on which the improved attachment is mounted has front and rear panels 28 and 29 with upper laterally spaced leg portions **28*a* and 29*a* having tubular hinge portions 30 connecting their upper ends. A transverse handle bar 31 connects the hinge portions 30, and a bar 31 preferably has an I beam cross section. The enlarged flange portions 16 at the bottom of panel 10 are outwardly offset to enclose the end caps 30' on hinge portions 30. The construction and operation of the hinge connection between the panels 28 and 29** is set forth in U.S. Pat. No. 4,253,260, previously referred to under "Background Art" herein.

As indicated in FIGS. 5–8, the improved extension panel 10 is mounted on the top of the floor sign by wrapping the sleeve portions 18 and 22 around the transverse handle 31 and inserting the barbed tabs 24 into the slotted ears 25. As the extension panel 10 is manually swung upwardly from the folded position of FIG. 7 to the upwardly extended position of FIGS. 5 and 6, the barbed tongues 26 yield laterally inward as they pass through the openings between the legs 29a of the floor sign and then snap behind the edges of the legs to lock the extension against return movement clockwise as viewed in FIGS. 3, 5 and 6. Further upward or counterclockwise movement is prevented by abutment of the bottom edge portion of panel 10 with the top porton of the floor sign. In order to fold the extension panel downward to the position of FIG. 7, the tongues 26 are first manually squeezed inwardly to pass the legs 29a and the extension is then free to swing downwardly to the folded position of FIG. 7.

Accordingly, the extension panel 10 may be stored folded or extended upwardly as desired, and when the panels of the floor sign are folded together with the extension panel also folded a very compact package is provided when not in use. Obviously, the extension panel may bear suitable warning insignia on both sides at a height which is visible at increased distances and above common obstructions, and when folded it functions the same as floor signs of conventional height.

The improved attachment is made entirely of plastic material which will not rust or dent and is quickly attached to or detached from the upper hinge portion of a self-standing floor sign without the use of tools.

I claim:

1. A self-standing floor sign comprising:

a first floor sign panel having an upper end and a lower end;

a second floor sign panel having an upper end and a lower end;

means for hingably connecting said first floor sign panel to said second floor sign panel at said upper ends for selectively positioning apart said lower ends of said floor sign panels relative to each other;

a transverse handle integrally associated with said means for hingably connecting;

an extension panel;

means for pivotally connecting said extension panel to said handle, said means being coaxial with said means for hingably connecting; and, means for selectively positioning said extension panel upwardly relative to said first and second floor sign panels when said lower ends of the latter are positioned apart relative to each other.

2. A self-standing floor sign as described in claim 1, wherein said means for selectively positioning said extension panel includes yieldable means for engaging one of said floor sign panels to hold said extension panel in upright position.

3. A self-standing floor sign as described in claim 2, wherein said extension panel and said means for pivotally connecting are constructed entirely of plastic material.

4. A self-standing floor sign as described in claim 1, wherein said floor sign panels have laterally spaced upper legs hinged together and connected by said transverse handle, and said extension panel has yieldable means for engaging the legs on one of said floor sign panels to hold said extension panel in upright position.

5. A self-standing floor sign as described in claim 4, wherein said means for pivotally connecting comprise spreadable half sleeve portions hinged at one edge for encircling said handle, and means for detachably connecting said sleeve portions together in closed position encircling said handle.

6. A self-standing floor sign as described in claim 1, wherein said means for pivotally connecting comprise spreadable half sleeve portions hinged at one edge for encircling said handle, and means for detachably connecting said sleeve portions together in closed position encircling said handle.

7. A self-standing floor sign as described in claim 6, wherein said means for selectively positioning said extension panel includes yieldable means for engaging one of said floor sign panels to hold said extension panel in upright position.

8. A self-standing floor sign as described in claim 7, wherein said extension panel and said means for pivotally connecting are constructed entirely of plastic material.

9. A self-standing floor sign as described in claim 6, wherein said half sleeve portions are hinged together at one end by means of an integral flexible web defining a living hinge.

10. A self-standing floor sign as described in claim 9, wherein said means for selectively positioning said extension panel includes yieldable means for engaging one of said floor sign panels to hold said extension panel in upright position.

* * * * *